US006896101B2

(12) United States Patent
Cowin

(10) Patent No.: US 6,896,101 B2
(45) Date of Patent: May 24, 2005

(54) CLIMBING DEVICE

(75) Inventor: Louis J. Cowin, Bohemia, NY (US)

(73) Assignee: Lou Done, LLC, Ronkonkoma, NY (US)

( * ) Notice: Subject to any disclaimer, the term of this patent is extended or adjusted under 35 U.S.C. 154(b) by 0 days.

(21) Appl. No.: 10/638,155

(22) Filed: Aug. 8, 2003

(65) Prior Publication Data

US 2005/0029045 A1 Feb. 10, 2005

(51) Int. Cl.[7] ..... E04G 3/00
(52) U.S. Cl. ..... 182/92; 182/133
(58) Field of Search ..... 182/92, 133, 134, 182/135, 136, 221; 46/132

(56) References Cited

U.S. PATENT DOCUMENTS 3,575,405 A * 4/1971 Harding ..... 269/258
4,368,801 A * 1/1983 Lewis ..... 182/134
4,492,401 A * 1/1985 Renfroe et al. ..... 294/101
4,785,536 A * 11/1988 Freyman ..... 30/124
5,050,465 A * 9/1991 Haugs ..... 81/126
5,400,869 A * 3/1995 Rocourt ..... 182/133
5,435,214 A * 7/1995 Sisson ..... 81/376
5,806,628 A 9/1998 Fullam et al.
5,885,298 A * 3/1999 Herrington et al. ..... 606/88
6,041,891 A 3/2000 Fullam et al.
6,161,647 A * 12/2000 Braden et al. ..... 182/8
6,178,855 B1 * 1/2001 Bally et al. ..... 81/355
6,648,315 B1 * 11/2003 Lee ..... 269/6
6,708,587 B1 * 3/2004 Noniewicz et al. ..... 81/322

* cited by examiner

*Primary Examiner*—Bruce A. Lev
(74) *Attorney, Agent, or Firm*—Dilworth & Barrese, LLP

(57) ABSTRACT

A climbing device is configured to have a locking mechanism operative to allow the handle and the footplate of the climbing device to pivot to and engage a portion of building structure in a position, in which further displacement of the footplate and handle relative to one another is arrested to lock the portion between the jaws of the device.

16 Claims, 2 Drawing Sheets

CLIMBING DEVICE

BACKGROUND OF THE INVENTION

1. Field of the Invention

The present invention relates to devices attachable to frames of structures such as buildings, towers, bridges, and the like both during and after the construction of the structure. In particular, the invention relates to a climbing device removably attachable to a beam, girder or column of the building frame, such as an I-beam, to provide secure footing or secure attachment for construction personnel to the frame while working on the building.

2. Discussion of the Prior Art

The construction of large steel structures, such as office buildings, bridges, apartment dwellings, and other large multi-story buildings, often times place construction personnel in potentially hazardous locations during both the construction of the building and after its completion, typically during maintenance and general upkeep of the structure. Typically, during construction, after the foundation is laid the building frame is constructed of steel beams having the general cross-section in the shape of an "I", and are typically known as I-beams. As the I-beams are laid in place, they are bolted together to form the frame of the building so that the floors and walls may be put in place as construction of the building moves towards completion.

The I-beams are generally lifted into place by cranes and other large pieces of equipment, and then are joined by steelworkers who bolt the I-beams into place at specific locations. The steel workers are typically located in potentially hazardous locations, in that there is no flooring or secure footing in place until the I-beams are actually bolted into place. The steelworker may bolt the I-beams into place while standing in the bucket of a conventional bucket truck, or, in more common situations, the worker must wrap a safety tether or belt around an I-beam or column already in place, and connect the belt or tether to a harness which he wears on his upper body. This makes for a slow and tedious process; each time the worker moves from beam to beam, he must disconnect himself, unwrap the tether from the column or beam, and move to the next location.

A further disadvantage of the existing methods for constructing building frames lies in the fact that most I-beams upon which workers are expected to stand are typically between 8" and 24" wide. The thinner the beam, the less footing the worker has on which to stand and consequently the worker must take great care to secure his footing and tether himself to the existing frame of the building. This slows the construction process, and consequently increases the cost of both the construction of the building, and its related costs such as insurance premiums.

A climbing device overcoming the above-discussed disadvantages is disclosed in U.S. Pat. Nos. 5,806,628 and 6,041,981 to Fullam et al. and is fully incorporated herewith by reference. With the modern building structures becoming more and more tall and complex, the demands to the safety of steel workers also rise. Some of the newly developed safety requirements may not be fully met by known devices.

A need exists for a climbing device having simple kinematics and configured to have a locking mechanism securely attaching the climbing device to the I-beam or column while providing for a secure and rapid connection of the climbing device to building structures.

SUMMARY OF THE INVENTION

This need is met by a climbing device configured to have a lever-actuating assembly, operating the climbing device so as to engage an I-beam, and a locking mechanism preventing displacement of the lever-actuating assembly in its desired position relative to the I-beam. The climbing device is utilized to provide a foothold to the user, and a means to attach the user, through a tether arrangement, to the structure to reduce the possibility of a fall through an accidental slippage.

In one aspect, the lever-actuating assembly includes a handle and a footplate components, which are connected to a piston configured to engage and secure the I-beam so that rotation of these components relative one another causes the piston to move linearly between its engaging and locked positions. In contrast to many known functionally similar devices requiring a combination of external linkages, which connect the piston to at least one of the components, the invention provides for direct connection between the piston and the components, thus, avoiding additional cost-inefficient parts and a complicated structure. In fact, since the space at a construction site is limited, the inventive device is advantageously distinguished from the known devices since its structure is compact.

In accordance with another aspect, the inventive device has a locking mechanism configured to prevent relative displacement of the handle and the footplate components relative one another once the piston secures the device to the I-beam in its locked position. Structurally, the locking mechanism includes preferably a ratchet assembly and a release assembly operated manually by the worker.

It is therefore an object of the invention to provide a climbing device attachable to a structure in a reliable manner.

A further object of the invention is to provide a climbing device configured to have a simple and reliable locking mechanism preventing disengagement of the climbing device from the engaged structure upon loading of the inventive device.

Still another object of the invention is to provide a climbing device with a locking mechanism releasable in response to the force generated by the user in a simple manner allowing the user to change his/her position by reengaging the climbing device to another support in a time-efficient manner.

Another object of the invention is to provide a climbing device characterized by a structure that can be easily serviced to maintain the originally assembly parts as well as to replace those with new parts, if a need exists.

BRIEF DESCRIPTION OF THE DRAWINGS

These and other features of the present invention will become more readily apparent as described in the following detailed description of the preferred embodiments, taken in conjunction with the accompanying drawings, in which.

DETAILED DESCRIPTION OF THE PREFERRED EMBODIMENT

Figure 1:
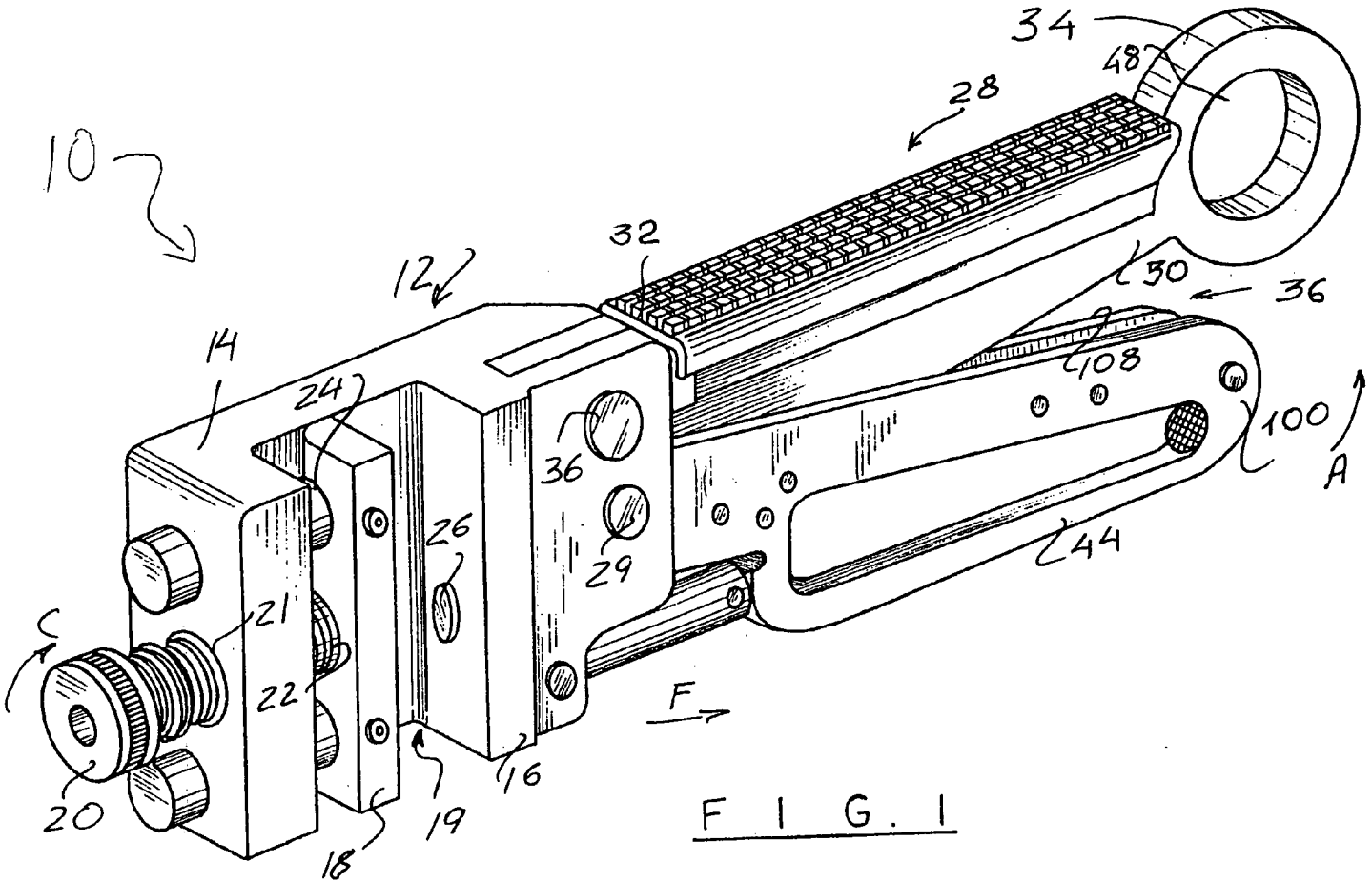
FIG. 1 illustrates a perspective view of the climbing device of the present invention.

Turning now to the drawings, in which like reference numerals identify similar or identical elements throughout the several views, the climbing device 10 of the present invention is illustrated in FIG. 1. Device 10 is preferably constructed of a metal material such as steel in order to support the weight of a person using the device and to prevent damage to the device during use. However, other suitable materials having a high impact strength or hardness may be utilized.

Climbing device 10, as seen in FIG. 1, includes a jaw assembly 12 constructed of a "U" shaped frame 14 in which one of the legs defines a first stationary jaw 16 while the other jaw 18 is operative to move relative to the first jaw 16. Except for the movable jaw, the frame 14 may be assembled of multiple parts, but preferably, in order to increase its resistance to bending loads, the frame is configured as a one-piece structure. Movable jaw 18 may be displaced to adjust a spacing 19 between the jaws 16 and 18, and, as shown in FIG. 1, is actuated by an adjustment knob 20, which rotates adjustment screw 22. Movable jaw 18 advances along guide pins 24, so that the distance between the jaws 16 and 18 may be varied to accommodate different sizes of building frames, in particular I-beams or columns. Once the spacing 19 is set, device 10 may be secured to the building frame in a manner described below. Jaw member 16 preferably includes an aperture through which a movable piston member 26 passes. Piston member 26 is connected to a lever-actuating assembly 28 through the provision of substantially cylindrical bodies including pins 36 and 29. The lever-actuating assembly 28 extends substantially perpendicular to the generally parallel first and second jaw members and includes a support footplate 30 to provide a foot hold for a user and a handle 44. Preferably, the latter is P-shaped and, thus, has an opening which is dimensioned so as to allow the user's hand to conveniently grasp the handle. Footplate 30 may include a plurality of grip members 32 to reduce the possibility of slippage when a user is standing on the climbing device 10. A back plate 34 may be provided to prevent the user's foot from slipping off the back end of the support member during use.

In use, after spacing 19 between the jaws 16, 18 is adjusted by rotating the knob 20 in a direction of arrow C (FIG. 1), the climbing device 10 may be attached to the I-beam by moving piston member 26 away from jaw 18. A force applied to the handle 44 causes both the handle and the footplate to pivot about the pins 29 and 36, respectively, mounted to the frame 14. Since both the footplate 30 and handle 44 are also attached to the piston 26 by spaced apart shafts 52 and 58, the piston 26 moves linearly inwards into the jaw 16 to clear the spacing 19. The geometry of the footplate, having generally a hammer-like shape, and the P-shaped handle necessitates, on one hand, a play between the frame 14 and the footplate/handle assembly and, on other hand, between the footplate/handle assembly and the piston. Small clearances between the shafts 52 and 58 anchored to the piston 26 and openings 51, 57 (FIG. 3) formed in the footplate 30 and the handle 44, respectively, allow the piston to move smoothly along a linear path while rotating both the handle and footplate. Additionally, the pins 29 and 36 attached to the frame 14 and the channels 27, 37 formed in the footplate and handle, respectively, have a breadth of play allowing angular displacement of the footplate and handle. Slight modifications including, for example, oversized channels formed in the piston 26 and allowing, in this case, the shafts 52, 58 to be anchored to the footplate 30 and handle 44, respectively, can be introduced without changing the kinematics of the structure. Overall, the device 10 is configured to have the piston 26 move to the position shown in FIG. 3 to accommodate attachment to an I-beam. Once the device 10 is placed in the desirable position, upon ceasing an external force applied to handle 44, the piston is displaced back to its locked position.

Figure 2:
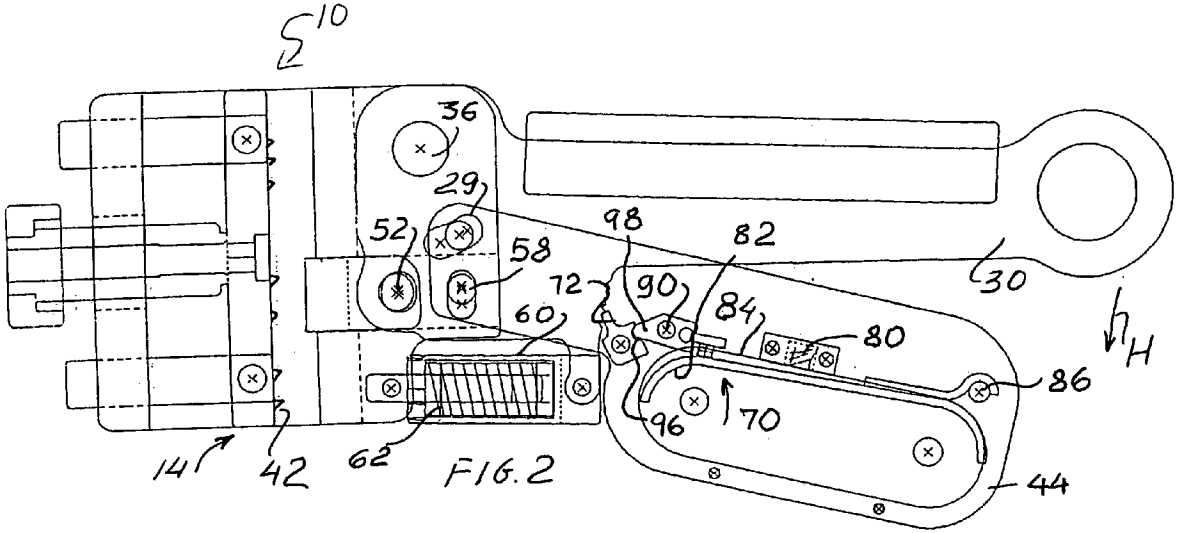
FIG. 2 illustrates a side elevational cutaway view of the climbing device of FIG. 1 shown in a locked position thereof as the climbing device would lock when in use.
Figure 3:
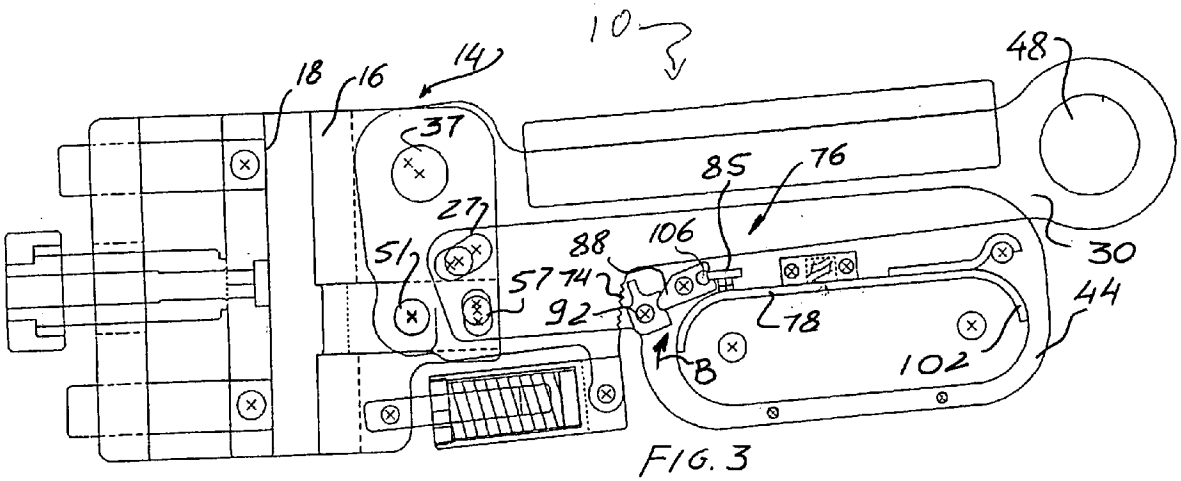
FIG. 3 illustrates a side elevational cutaway view of the climbing device with its handle compressed as the climbing device would lock when it is being attached to or detached from an I-beam.

In order to displace the piston 26 to the position shown in FIG. 3, the external force applied to the handle 44 should be sufficient to overcome the force generated by a spring 60 of a damping plunger 62 coupled between the handle 44 and the frame 14. Having overcome the spring force, the handle 44 actuates the piston 26 through the shaft 58 (FIG. 2), whereas the displacement of the piston causes the footplate 30 to rotate from the position shown in FIG. 2 to the position of FIG. 3. Once the spring 60 is tensioned in the position of the piston 26 (FIG. 3), and, upon ceasing the external force, the spring 60, acting in a direction of arrow F (FIG. 1), forces the handle to pivot towards its initial position, as shown in FIGS. 1 and 2. Displacement of the handle 44 is translated into linear displacement of the piston 26, which eventually assumes its locked position, as illustrated in FIGS. 1 and 2, as the footplate 30 moves to its initial position extending generally parallel to a longitudinal direction of the device 10.

To prevent undesirable displacement of the footplate 30 from the locked position, the device 10 is provided with a locking mechanism 70 (FIG. 2) that is preferably located between the handle 44 and the footplate 30. The locking mechanism 70 includes a pawl 72 running along a toothed rack 74 so that when the handle 44 is under an external force applied by the user, the pawl 72 moves without engaging the rack 74 until the piston 26 reaches the position shown in FIG. 3. However, removing the external force causes the pawl 72 to frictionally slide back to a position, as shown in FIG. 2, which, once the piston 26 assumes the locked position is locked upon meshing the pawl 72 and a respective notch between adjacent teeth of the rack 74. Accordingly, engagement between the pawl and the toothed rack ensures the locked position of the piston 26.

To release the pawl 72, the handle 44 is provided with a spring-loaded cam assembly 76 (FIG. 3) which, when actuated, lifts the pawl 72 off the toothed rack 74 and, thus, allows displacement of the handle 44 relative to the frame 14. A flexible arm 78, attached by one of its ends 102 to the handle 44 and extending between fingers 100 and 108 of the handle 44, actuates the cam assembly 76 by flexing about an axis 86 (FIG. 2) against a force applied by a spring 80. Displacement of the arm 78 along a direction "A" (FIG. 1) causes its inner end 82 (FIG. 2) to move towards a support surface 84 extending between the fingers 100 and 108 of the handle 44, which, in turn, displaces a trigger 85 (FIG. 3) fixed to the end 82 of the arm 78. As a result, a cam plate 88, connected to the trigger 85 by a button 106 (FIG. 3), pivots about an axis 90 (FIG. 2) relative to the handle 44. The cam plate 88 is so shaped and dimensioned that it forces the pawl 72 to rotate in a direction "B" about an axis 92 (FIG. 3) away from the toothed rack 74. Once, the pawl 72 is lifted off the rack, displacement of the handle from its initial position, as shown in FIG. 2, is cleared. Conversely, removing an external force causes the spring 80 to move the arm 78, displacement of which is transferred through the trigger 85 and cam plate 88 to the pawl 72. As a result, the pawl 72 pivots back to the position, as shown in FIG. 2, in which it lockingly engages the rack 74 and, thus, locks the piston 26.

Structurally, the pawl 72 is provided with a curved notch 96 (FIG. 2) serving as a guide and motion translating surface formed complementary to a lobe 98 of the cam plate 88. Relative positions of the lobe 98 and the notch 96 can be exchanged so that the cam plate 88 is provided with the notch, while the pawl 72 has the lobe. The toothed rack can be formed along any convenient stretch of the footplate 30 and configured to allow a leaf spring, not shown, to engage this toothed rack without the use of a cam mechanism.

When the handle is released, climbing device 10 returns to a previously selected position corresponding to the desired spacing 19 in which the piston 26 and grip enhancing points 42 engage a portion of the I-beam or column, as shown in FIG. 2. The grip enhancing points 42 are preferably constructed of a hardened steel material, which in effect "bite" into the I-beam or column to lock the I-beam or column between jaws 18 and 16.

Climbing device 10 may include a tether attachment portion having an eyelet 48 for connection to a tether line, such as a rope or other safety device. It is also contemplated that eyelet 48 may connect to a tether which ultimately is connected to a harness vest or belt worn by the user. Accordingly, should a person using the climbing device slip and fall, the tether passing through eyelet 48 and attached to the user's body will reduce the possibility of a free fall.

Turning now to FIG. 1, device 10 is shown in the at rest position in which handle 44 is in a position away from footplate 30. In this position, the piston 26 extends through the face of second jaw member 16 as shown, and ultimately will cooperate with grip enhancing points 42 which protrude from the face of jaw 18. Adjustment screw 22 is preferably spring biased by adjustment spring 21 (FIG. 1), so that adjustment screw 22 only moves upon manual rotation of the knob 20, resulting in linear displacement of jaw 18. Once the climbing device is positioned on the I-beam in the locked position of FIG. 2, the user may step on the footplate 30, which creates a downward force in the direction of arrow "H" (FIG. 2) causing the support member 28 to rotate in a clockwise direction about the pin 36 and force piston member 26 further through the face of jaw 16 to provide a greater force on the I-beam. Furthermore, the downward force "H" creates a moment force, which drives the grip enhancing points 42 into the I-beam with greater force to lock the climbing device 10 in place. Once the piston 26 establishes its locked position, the latter is secured by the locking mechanism 70 preventing accidental displacement of the piston 26 from its locked position.

While the present invention has been described with respect to the preferred embodiment, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. A climbing device for attachment to a portion of a structure comprising:

a frame;

opposing jaws slideable relative to one another along the frame to engage a portion of the structure therebetween;

a footplate mounted to the frame and configured to support a load;

a handle mounted to the frame and coupled to the footplate, the footplate and the handle being displaceable relative to one another in response to an external force applied to the handle between a position in which the climbing device is capable of sliding relative to the structure upon engagement of the portion thereof by the jaws, and a position in which the structure is locked between the jaws upon ceasing the external force; and a locking mechanism located between the footplate and the handle and configured to prevent displacement thereof relative to one another upon ceasing the external forces the locking mechanism includes a toothed rack and a pawl selectively meshing with the toothed rack upon removing the external force from the handle to ensure locking of the portion of the structure between the jaws, and a flexible arm pivotally coupled to the handle and operative to lift the pawl off the toothed rack to release the handle relative to the footplate in response to the external force applied to the handle.

2. The climbing device of claim 1, wherein the locking mechanism further includes a cam plate coupled to the pawl and to a trigger fixed to the flexible arm and displaceable therewith in response to the external force applied to the handle, the trigger being configured to move the cam plate so that the pawl disengages the toothed rack in response to applying the external force to the handle.

3. The climbing device of claim 2, wherein the pawl is mounted rotatably to the handle and configured to engage the cam plate mounted rotatably to the handle so that when the cam plate rotates in one direction upon ceasing the external force, the pawl rotates in a direction opposite to the one direction to mesh with the toothed rack and to lock the handle and the footplate relative to one another upon ceasing the external force.

4. The climbing device of claim 3, wherein one of the pawl and the cam plate is provided with a notch, while the other one has a lobe configured so that rotation of the cam plate in the one direction causes rotation of the pawl in the opposite direction.

5. The climbing device of claim 2, wherein the trigger is fixed to and configured to translate pivotal motion of the flexible arm upon applying the external force to the handle into rotational motion of the cam plate engaging the pawl so that the pawl rotates out of engagement with the toothed rack.

6. The climbing device of claim 1, wherein the flexible arm is spring biased so that when the external force is not applied to the handle, the pawl engages the toothed rack to lock the handle with respect to the footplate.

7. The climbing device of claim 1, further comprising a piston coupled to the footplate and to the handle and slidably mounted to the frame to move linearly from a release position, in which a space between the opposing jaws is cleared, and a locked position, in which the piston extends into the space between the opposing jaws.

8. The climbing device of claim 7, further comprising two spaced apart parallel shafts extending through a pair of channels formed in the piston and mounted to the handle and footplate, respectively, to translate pivotal motion of the handle and footplate to linear motion of the piston.

9. The climbing device of claim 8, wherein each pair of channels and corresponding shafts form a radial clearance therebetween to allow the handle and the footplate to pivot while the piston is linearly displaced.

10. The climbing device of claim 8, further comprising two spaced pins extending parallel to the shafts and spaced therefrom to extend through respective openings formed in the handle and the footplate and each having a respective diameter slightly larger than a diameter of the pins to allow the handle and footplate to pivot while the piston moves linearly.

11. A climbing device for attachment to a portion of a structure comprising:

opposing jaws slideable relative to one another;

a footplate mounted pivotally to one of the jaws and configured to support a load;

a handle mounted pivotally to the one jaw and coupled to the footplate;

a reciprocating piston attached to the footplate and the handle and movable linearly in response to pivoting one of the handle and the footplate from a first position, in which a portion of the structure is placed between the opposing jaws, and a second position, in which the portion of the structure is secured between the other jaw and the reciprocating piston; and a locking mechanism located between the footplate and the handle and configured to prevent displacement thereof relative to one another in the second position thereof, to which the piston moves upon ceasing an external force applied to the handle, the locking mechanism including a toothed rack and a pawl selectively meshing with the toothed rack in the second position, and a flexible arm pivotally coupled to the handle and operative to lift the pawl off the toothed rack to release the handle relative to the footplate upon applying the external force to the handle.

12. The climbing device of claim 11, further comprising two parallel and spaced-apart shafts traversing the reciprocating piston and terminating in the handle and footplate, respectively, to transmit pivotal motion of the footplate and the handle into linear motion of the piston towards the second position thereof in response to application of external force to the handle.

13. The climbing device of claim 11, wherein the locking mechanism further includes a cam plate coupled to the pawl and to a trigger fixed to the flexible arm and displaceable therewith in response to the external force applied to the handle, the trigger being configured to move the cam plate so that the pawl disengages the toothed rack in the second position, the flexible arm being spring biased so that when the external force is not applied to the handle, the pawl engages the toothed rack to lock the handle with respect to the footplate.

14. The climbing device of claim 13, wherein the pawl is mounted rotatably to the handle and configured to engage the cam plate mounted rotatably to the handle so that when the cam plate rotates in one direction upon ceasing the external force, the pawl rotates in a direction opposite to the one direction to mesh with the toothed rack and to lock the handle and the footplate relative to one another in the second position thereof.

15. The climbing device of claim 14, wherein one of the pawl and the cam plate is provided with a notch, while the other one has a lobe configured so that rotation of the cam plate in the one direction causes rotation of the pawl in the opposite direction.

16. The climbing device of claim 11, further comprising a damping plunger provided with a plunger spring braced between the one jaw and the handle to bias the handle to the locked position upon ceasing the external force.

* * * * *